US006267368B1

(12) United States Patent
Tomoe et al.

(10) Patent No.: US 6,267,368 B1
(45) Date of Patent: Jul. 31, 2001

(54) PAPER RETURN DEVICE AND IMAGE FORMING APPARATUS

(75) Inventors: Tetsuro Tomoe; Kenji Oda; Shinji Yamamoto; Eijiro Masaki; Susumu Hanano; Yukihiro Itoh; Takashi Mihara, all of Osaka (JP)

(73) Assignee: Kyocera Mita Corporation, Osaka (JP)

( * ) Notice: Subject to any disclaimer, the term of this patent is extended or adjusted under 35 U.S.C. 154(b) by 0 days.

(21) Appl. No.: 09/233,624

(22) Filed: Jan. 19, 1999

(30) Foreign Application Priority Data

Jan. 19, 1998 (JP) ..... 10-007965
Jan. 19, 1998 (JP) ..... 10-007966

(51) Int. Cl.[7] ..... B65H 5/26
(52) U.S. Cl. ..... 271/9.09; 271/301; 271/65
(58) Field of Search ..... 271/9.09, 301, 271/65, 186

(56) References Cited

U.S. PATENT DOCUMENTS 4,968,016 * 11/1990 Koyama ..... 271/9.09
5,056,768 * 10/1991 Koyama ..... 271/9.09
5,615,872 * 4/1997 Mochimaru ..... 271/301
5,957,450 * 9/1999 Kida et al. ..... 271/291

FOREIGN PATENT DOCUMENTS

0086326 * 5/1986 (JP) ..... 271/301
363134435 * 6/1988 (JP) ..... 271/9.09
401308323 * 12/1989 (JP) ..... 271/9.09

* cited by examiner

*Primary Examiner*—Donald P. Walsh
*Assistant Examiner*—Daniel K Schlak
(74) *Attorney, Agent, or Firm*—Jordan and Hamburg LLP

(57) ABSTRACT

A paper return device detachably fitted to an image forming apparatus having a paper feeding port for feeding paper from outside the image forming apparatus, a paper transport mechanism for transporting the paper from the paper feeding port to an image forming unit and a paper output port from which the paper carrying an image formed by the image forming unit is ejected to the outside of the image forming apparatus. The paper return device includes a paper return guideway which connects the paper output port of the image forming apparatus to its paper feeding port when the paper return device is fitted to the image forming apparatus, whereby the paper ejected from the paper output port is fed back to the paper feeding port through the paper return guideway.

8 Claims, 10 Drawing Sheets

PAPER RETURN DEVICE AND IMAGE FORMING APPARATUS

BACKGROUND OF THE INVENTION

The present invention relates to an image forming apparatus, such as a copying machine or a facsimile machine, having a multiple image forming capability to perform a double-sided image transfer or combined image transfer operation, for instance, as well as to a paper return device which is added to an image forming apparatus to give it multiple image forming capability.

In one previous approach to realizing the multiple image forming capability in a copying machine, one side of each sheet of a document is successively copied, individual sheets of copying paper, each carrying a reproduced image on one side, are stacked as if in a stock, and then the other side of each sheet of the document is successively copied. This approach is known as a stock method. In another previous approach known as a non-stock method, two sides of each sheet of a document are copied in succession on two sides of each sheet of copying paper before copying on a succeeding sheet of copying paper.

In one known example of a non-stock type copying machine, a sheet of paper carrying an image reproduced on one side in an image forming section provided inside a main body of the copying machine is ejected through a paper output port, which opens to the outside of the main body of the copying machine, the ejected sheet is transferred to a paper return slot formed in the main body of the copying machine by a reversible paper transport unit which is detachably fitted to the main body, and the sheet reentering from the paper return slot is fed again to the image forming section through a re-feeding path. In this construction, it is possible to provide a paper re-feed mechanism for double-sided copying operation in the form of the reversible paper transport unit which is detachably fitted to the main body of the copying machine. This means that the aforementioned construction makes it possible to provide a double-sided copying mechanism as an optional unit and thereby increase the ease of maintenance.

Today's copying machines are mostly of a type that accommodates paper trays in their main bodies. The majority of this type of copying machines also have manual feed trays for loading sheets of paper to be fed directly from outside their main bodies to permit manual paper feed as is the case with the aforementioned conventional copying machines.

As will be noted from the above discussion, a conventional copying machine having the aforementioned construction usually has two paper paths for feeding paper to an image forming section from outside a main body of the copying machine. These are a re-feeding path for feeding the paper transferred by a reversible paper transport unit and a manual feeding path for feeding individual sheets of paper loaded on a manual feed tray. A problem of this conventional structure is that the provision of more than one paper path for similar use leads to an inefficient use of available space and an increase in equipment cost.

SUMMARY OF THE INVENTION

It is therefore an object of the invention to provide a paper return device and an image forming apparatus which make it possible to achieve improved space utilization efficiency and cost reduction by combining multiple paper paths for feeding paper from outside a main body of the apparatus to an image forming section provided inside the main body into a single path.

In one aspect of the invention, an image forming apparatus comprises a paper return device which is detachably fitted to a main body of the image forming apparatus having a paper feeding port for feeding paper from outside, a paper transport mechanism for transporting the paper from the paper feeding port to an image forming unit and a paper output port ejecting the paper with an image formed by the image forming unit to the outside. The paper return device comprises a paper return guideway which connects the paper output port of the image forming apparatus to its paper feeding port when the paper return device is fitted to the image forming apparatus. The image forming apparatus also comprises a paper supply unit for re-feeding the paper ejected from the paper output port back to the paper feeding port through the paper return guideway.

When performing a double-sided copying operation using an image forming apparatus provided with the aforementioned paper return device, a sheet of paper ejected from the paper output port carrying an image on one side only is returned to the paper feeding port through the paper return guideway and fed again into the apparatus through the paper feeding port. Accordingly, it is not necessary to provide a dedicated manual feeding path in the apparatus for re-feeding the paper. This makes it possible to combine conventionally separate paper paths from outside of the apparatus to its internal image forming unit into a single path, and eventually achieve improved space utilization efficiency and cost reduction.

In another aspect of the invention, an image forming apparatus comprises an image forming unit provided inside a main body of the image forming apparatus for forming an image on paper, a paper transport mechanism for transporting the paper from a paper feeding port formed in the main body of the image forming apparatus opening to its outside to the image forming unit, a paper ejector for ejecting the paper carrying the image formed by the image forming unit to the outside of the main body of the image forming apparatus through a paper output port formed in the main body opening to its outside, and a paper return device having a paper return guideway which connects the paper output port to the paper feeding port to feed the paper ejected from the paper output port back to the paper feeding port through the paper return guideway.

When performing a double-sided copying operation using the image forming apparatus thus constructed, a sheet of paper ejected from the paper output port formed in the main body of the apparatus carrying an image on one side only is returned to the paper feeding port through the paper return guideway and fed again into the apparatus through the paper feeding port. Accordingly, it is not necessary to provide a dedicated manual feeding path in the apparatus for re-feeding the paper. This makes it possible to combine conventionally separate paper paths from outside the main body of the apparatus to its internal image forming unit into a single path, and eventually achieve improved space utilization efficiency and cost reduction.

These and other objects, features and advantages of the invention will become more apparent upon reading the following detailed description in conjunction with the accompanying drawings.

DETAILED DESCRIPTION

An embodiment of the invention is now described with reference to the accompanying drawings. The following discussion will present some specific forms of implementing the invention in an image forming apparatus. It is by no means intended, however, to limit the technical scope of the invention by the following detailed description.

Figure 1:
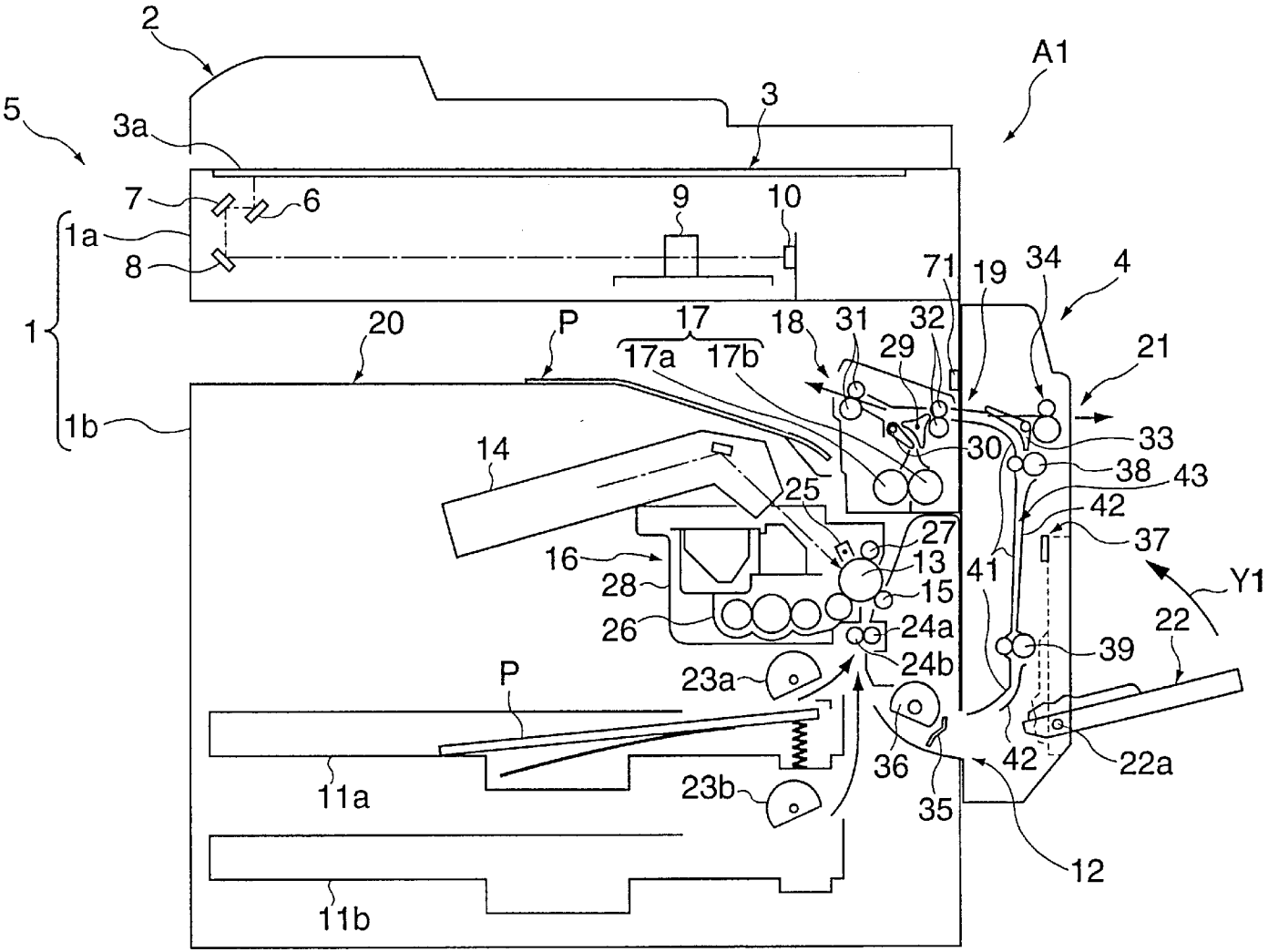
FIG. 1 is a schematic elevational view showing the internal construction of a copying machine according to an embodiment of the invention.

FIG. 1 is a schematic elevational view showing the internal construction of a copying machine A1 according to the embodiment of the invention.

The copying machine A1 of this embodiment is a non-stock type copying machine, which copies two sides of each sheet of a document in succession on two sides of each sheet of copying paper before copying on a succeeding sheet of copying paper during a double-sided copying operation, like the copying machine discussed in some detail in the foregoing description of the prior art.

The copying machine A1 comprises a main body 1 including an image reading section 1*a* which reads, or scans, an image of an original document and an image forming section 1*b* which forms a reproduced image on copying paper based on the original image scanned by the image reading section 1*a,* a reversible automatic document feeder 2 (hereinafter referred to as the RADF 2) mounted on top of an original glass plate 3 provided at the top of the image reading section 1*a* and a reversible paper transport unit 4 detachably mounted on a right side surface of the main body 1, as shown in FIG. 1.

The main body 1 and the RADF 2 together form an image forming apparatus while the reversible paper transport unit 4 constitutes a paper return device.

First, the construction of the RADF 2 and the image reading section 1*a* and their image scanning operation are generally described. Since neither the RADF 2 nor the image reading section 1*a* plays an essential part in the invention, the following discussion provides only their brief description. The RADF 2 is so constructed that multiple sheets of a document can be loaded together and the document loaded in the RADF 2 can be automatically fed one sheet after another to a scanning area 3*a* which will be described later. A description of the detailed construction and document feeding operation of the RADF 2 is not provided in this specification.

The image reading section 1*a* comprises the aforementioned original glass plate 3 and an optical scanning system 5 which illuminates a sheet of the document placed on the original glass plate 3 or a sheet of the document automatically fed over the scanning area 3*a,* which is located along an edge of the original glass plate 3, with a scanning light beam and receives light reflected from the document. The optical scanning system 5 includes a fluorescent lamp which is not shown, mirrors 6, 7 and 8 for guiding light reflected from a side of the original illuminated by the fluorescent lamp, a lens 9 and a line sensor 10 which receives the reflected light.

When a sheet of the document is transferred over the scanning area 3*a* by the RADF 2, one side of the sheet is illuminated and scanned by the optical scanning system 5 whose constituent elements are fixed in positions shown in FIG. 1. When copying a bound printed material like a book which is directly placed in a fixed position on the original glass plate 3 without using the RADF 2, part of the optical scanning system 5, e.g., the mirror 6, is moved from left to right (as illustrated in FIG. 1) to illuminate and scan each page of the printed material to be copied.

Next, the construction of the image forming section 1*b* and the reversible paper transport unit 4 and their image forming operation are generally described.

The image forming section 1*b* comprises paper cassettes 11*a,* 11*b* for holding paper stacks, the paper cassettes 11*a,* 11*b* being accommodated inside the main body 1 of the copying machine A1 in a manner that they can be drawn out of the main body 1, a manual feeding port 12 which permits an operator to manually feed sheets of copying paper P from outside the main body 1 of the copying machine A1, and a laser optical system 14 which projects a laser beam whose intensity varies in accordance with an input to the line sensor 10 of the optical scanning system 5 onto a photosensitive drum 13. The image forming section also includes image forming assembly 16 which transfers a toner image formed on the photosensitive drum 13 onto the paper P, a fixing roller pair 17 including a heating roller 17*a* and a pressure roller 17*b* for fixing the toner image onto the paper P, a paper delivery port 18 through which the paper P is ejected after it has passed through the fixing roller pair 17, a paper output port 19, a paper delivery table 20 for receiving each sheet of paper P ejected through the paper delivery port 18, and various paper transport means (which will be discussed in detail in an operational description given later) for transporting the paper P along the aforementioned elements. The image forming assembly 16 includes a static charger 25, a developing unit 26, an image transfer roller 15 and a cleaning roller 27 which are arranged in this order around the photosensitive drum 13 in its turning direction. The image forming assembly 16 thus constructed focuses the laser beam emitted by the laser optical system 14 onto a curved outer surface of the photosensitive drum 13 which has been uniformly charged by the static charger 25 to form an electrostatic latent image on the photosensitive drum 13, develops the electrostatic latent image into a toner image in the developing unit 26, transfers the toner image onto the paper P by means of the image transfer roller 15 and then collects the excess toner left on the surface of the photosensitive drum 13 by means of the cleaning roller 27. Among the aforementioned elements of the image forming assembly 16, the elements other than the image transfer roller 15 are assembled together to form a single structure which is hereinafter referred to as an image forming unit 28. The image forming unit 28 is mounted so that it can be drawn out of the main body 1 of the copying machine A1 through the front of the machine.

A detecting switch 35 is arranged close to the manual feeding port 12. The detecting switch 35 is turned ON when pushed by the leading edge of a sheet of paper P to thereby sense the paper P loaded on the manual feed tray 22.

The manual feeding port 12 is a paper feeding slot formed in the main body 1 of the copying machine A1 while the paper output port 19 is a paper ejecting slot formed in the main body 1. The image forming assembly 16 and the fixing roller pair 17 together constitute an image forming unit.

The reversible paper transport unit 4 includes a paper return guideway 43 which is formed of paper guides 41, 42 and other elements for guiding each sheet of paper P as well as a pair of transfer rollers 38 and a pair of transfer rollers 39 provided at appropriate positions along the paper guides 41, 42 to feed the paper P ejected through the paper output port 19 formed in the main body 1 back to the manual feeding port 12 formed in the main body 1. In this embodiment, the transfer rollers 38, 39 together constitute paper feeding means.

In this construction of the copying machine A1, the paper P ejected from the paper output port 19 of the main body 1 is transferred to the manual feeding port 12 and fed again to the image forming assembly 16 in a manner similar to ordinary manual paper feed operation. It would be recognized from the foregoing discussion that the copying machine A1 of this embodiment is not provided in its main body 1 with any extra paper path for feeding the paper P from outside the main body 1 up to the image forming assembly 16 other than a manual feeding path used in the aforementioned manual paper feed operation.

As the reversible paper transport unit 4 of the copying machine A1 is constructed as described above in this embodiment, it is possible to combine separate paper paths from outside the main body 1 to its internal image forming assembly 16 (as in conventional machines) into a single path, and this makes it possible to achieve improved space utilization efficiency and cost reduction.

The reversible paper transport unit 4 is further provided with a paper outlet 21 from which the paper P ejected through the paper output port 19 of the main body 1 is discharged without being transferred to the manual feeding port 12 and a manual feed tray 22 used when manually feeding the paper P into the manual feeding port 12. The manual feed tray 22 can be swung in the direction of arrow Y1 shown in FIG. 1 about a supporting point 22*a*. As a consequence, the manual feed tray 22 can be retracted in a side wall of the reversible paper transport unit 4 when not in use as shown by broken lines in FIG. 1.

The reversible paper transport unit 4 further includes a detecting switch 37 which is turned ON to sense that the manual feed tray 22 has been retracted when the manual feed tray 22 is swung up and fitted in the side wall of the reversible paper transport unit 4.

A detecting switch 71 is arranged in a joint area between the main body 1 of the copying machine A1 and the reversible paper transport unit 4. This detecting switch 71 is turned ON when the reversible paper transport unit 4 is attached to the main body 1 to sense that the reversible paper transport unit 4 has been fitted to the main body 1.

Figure 2:
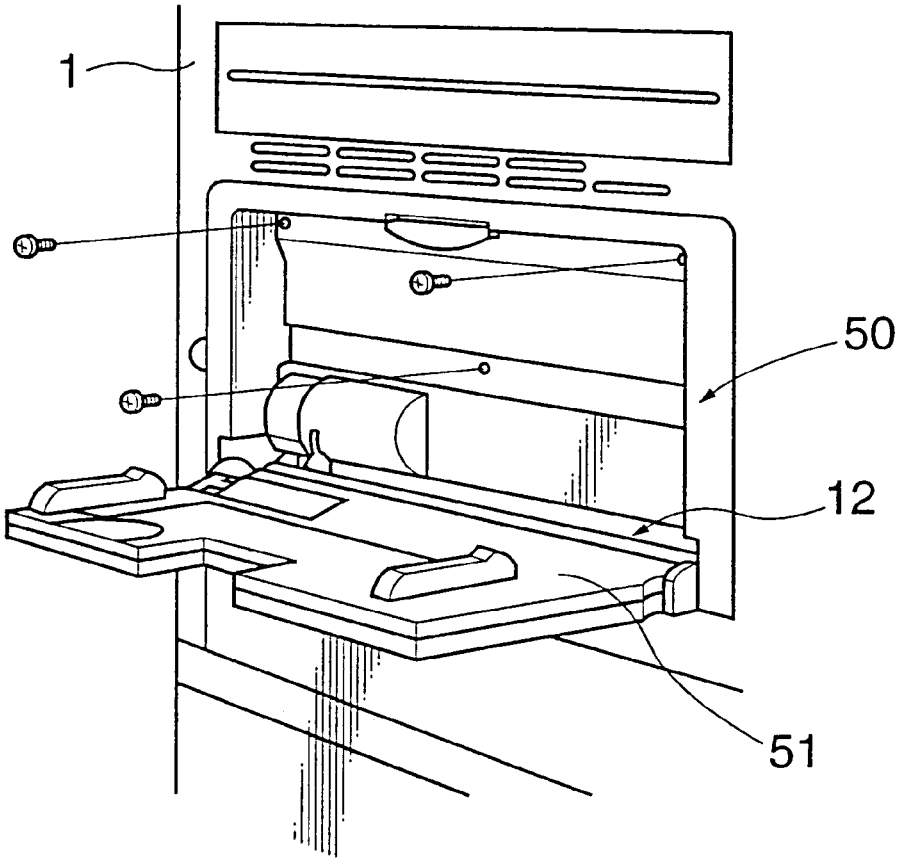
FIGS. 2 and 3 are perspective diagrams showing how a manual feed tray is set in position in a main body of the copying machine.
Figure 3:
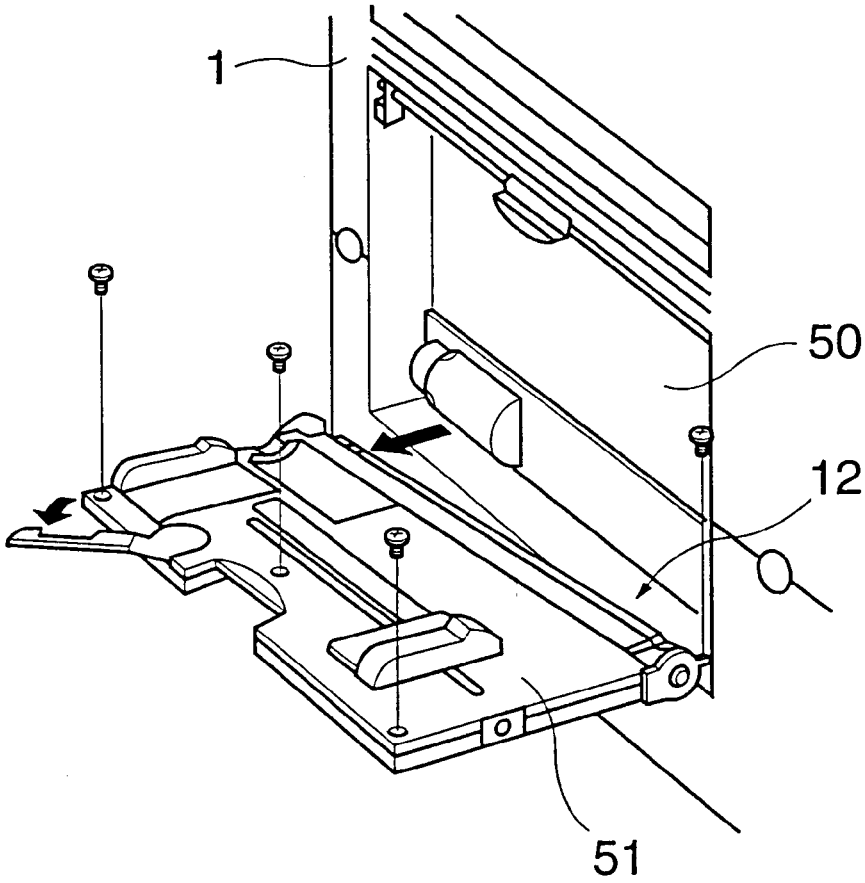
Figure 4:
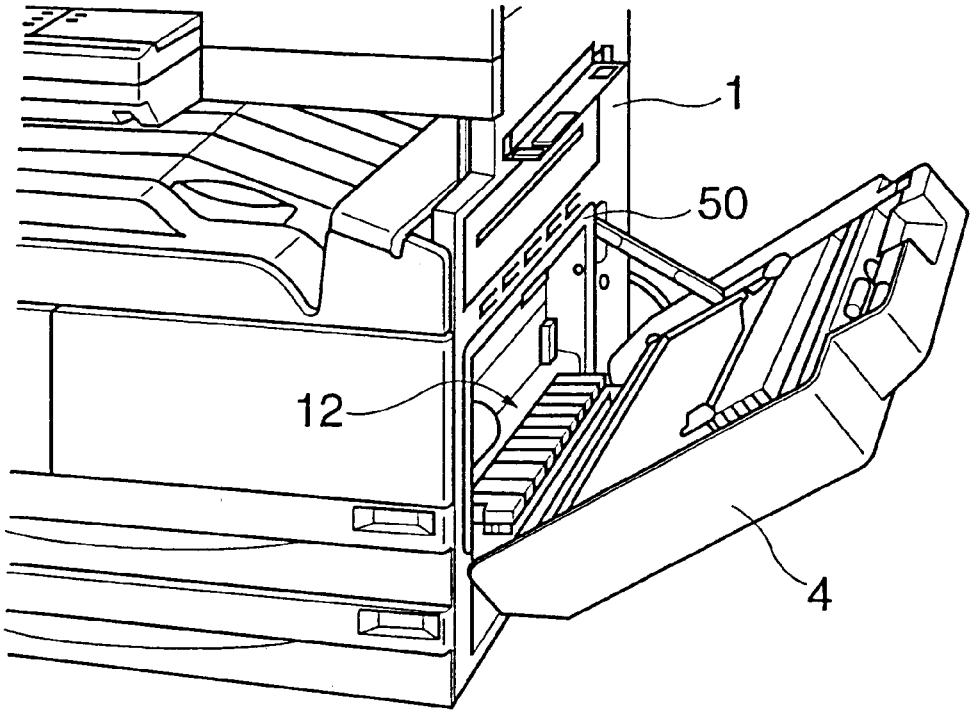
FIG. 4 is a perspective diagram showing how a reversible paper transport unit is fitted to the main body of the copying machine in place of the manual feed tray.

Referring now to FIGS. 2 through 4, a structure for fitting a second manual feed tray 51 and the reversible paper transport unit 4 to the main body 1 of the copying machine A1 is described. FIGS. 2 and 3 are perspective diagrams showing how the manual feed tray 51 is set in position in the main body of the copying machine A1, and FIG. 4 is a perspective diagram showing how the reversible paper transport unit 4 is fitted to the main body 1 of the copying machine A1 in place of the manual feed tray 51.

As shown in FIG. 2, there is attached a unit mounting part 50 to a side wall of the main body 1 of the copying machine A1 where the manual feeding port 12 is provided, and the manual feed tray 51 for loading sheets of paper P to be fed directly from outside the main body 1 is attached to the unit mounting part 50. The manual feed tray 51 constitutes a paper loading table and can be retracted in the side wall of the main body 1 in a manner similar to what has been described above with reference to the manual feed tray 22. When the manual feed tray 51 is retracted in the side wall of the main body 1, the manual feeding port 12 is closed by the manual feed tray 51.

When using the reversible paper transport unit 4, it is fitted to the copying machine A1 after removing the manual feed tray 51 from the main body 1 so that the manual feeding port 12 is not closed off. To make this possible, the manual feed tray 51 can be detached from the unit mounting part 50 by a procedure depicted in FIG. 3 and the reversible paper transport unit 4 can be attached to the unit mounting part 50, from which the manual feed tray 51 has been removed, as depicted in FIG. 4.

The provision of the unit mounting part 50 makes it possible to selectively fit the manual feed tray 51 or the reversible paper transport unit 4 to the main body 1 of the copying machine A1.

Figure 5:
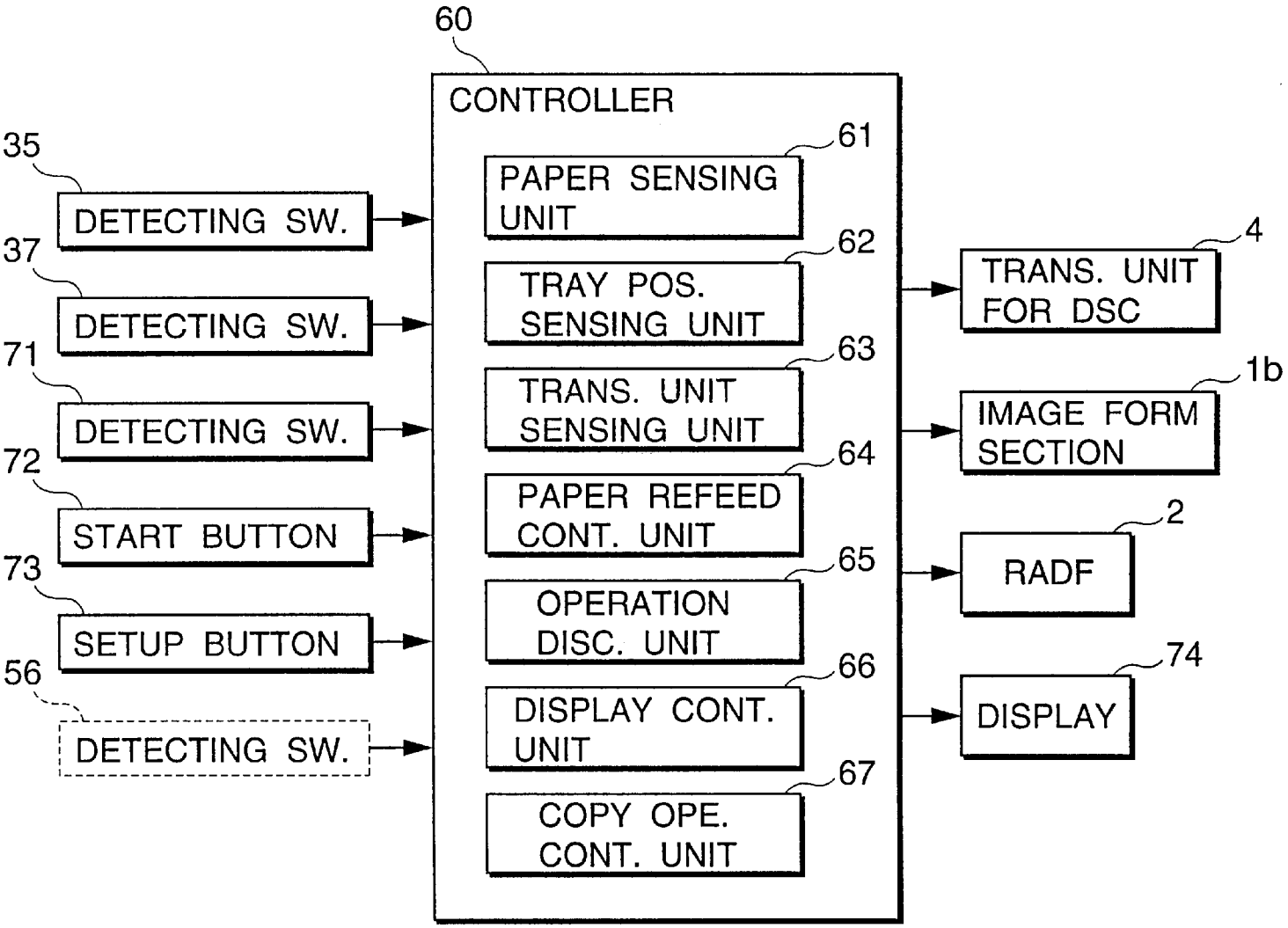
FIG. 5 is a block diagram of a control circuit of the copying machine.

FIG. 5 is a block diagram of a control circuit of the copying machine A1.

Referring to FIG. 5, there is shown a controller 60 which is formed of a central processing unit (CPU) and other components. Including functional blocks as illustrated in FIG. 5, the controller 60 controls the operation of individual elements of the copying machine A1.

A paper sensing block 61 of the controller 60 senses whether any copying paper P is loaded on the manual feed tray 22 according to on/off states of the detecting switch 35 provided near the manual feeding port 12.

A tray position sensing block 62 of the controller 60 judges whether the manual feed tray 22 is retracted into the reversible paper transport unit 4 according to on/off states of the detecting switch 37.

A transport unit sensing block 63 of the controller 60 judges whether the reversible paper transport unit 4 is mounted according to on/off states of the detecting switch 71.

A paper referred control block 64 of the controller 60 controls individual elements of the reversible paper transport unit 4 only when it is fitted to the main body 1 of the copying machine A1 and the manual feed tray 22 is retracted into the reversible paper transport unit 4.

An operation discriminating block 65 of the controller 60 discriminates contents of individual operational commands entered by operating such controls as a start button 72 for initiating a copying operation and setup buttons 73 for specifying the number of copies, selecting double-sided copy mode and entering other settings that are provided at appropriate positions of the main body 1 of the copying machine A1.

A display control block 66 of the controller 60 controls data contents presented on a display 74 constructed of a liquid crystal display (LCD) panel, for example, which is provided at an appropriate position of the main body 1 of the copying machine A1 and displays the contents of settings entered by using the setup buttons 73, warning messages and other information.

A copying operation control block 67 of the controller 60 controls the individual elements of the copying machine A1, such as the image forming section 1*b* and the RADF 2, so that they begin to operate when the start button 72 is pressed in accordance with the settings entered by using the setup buttons 73.

Figure 6:
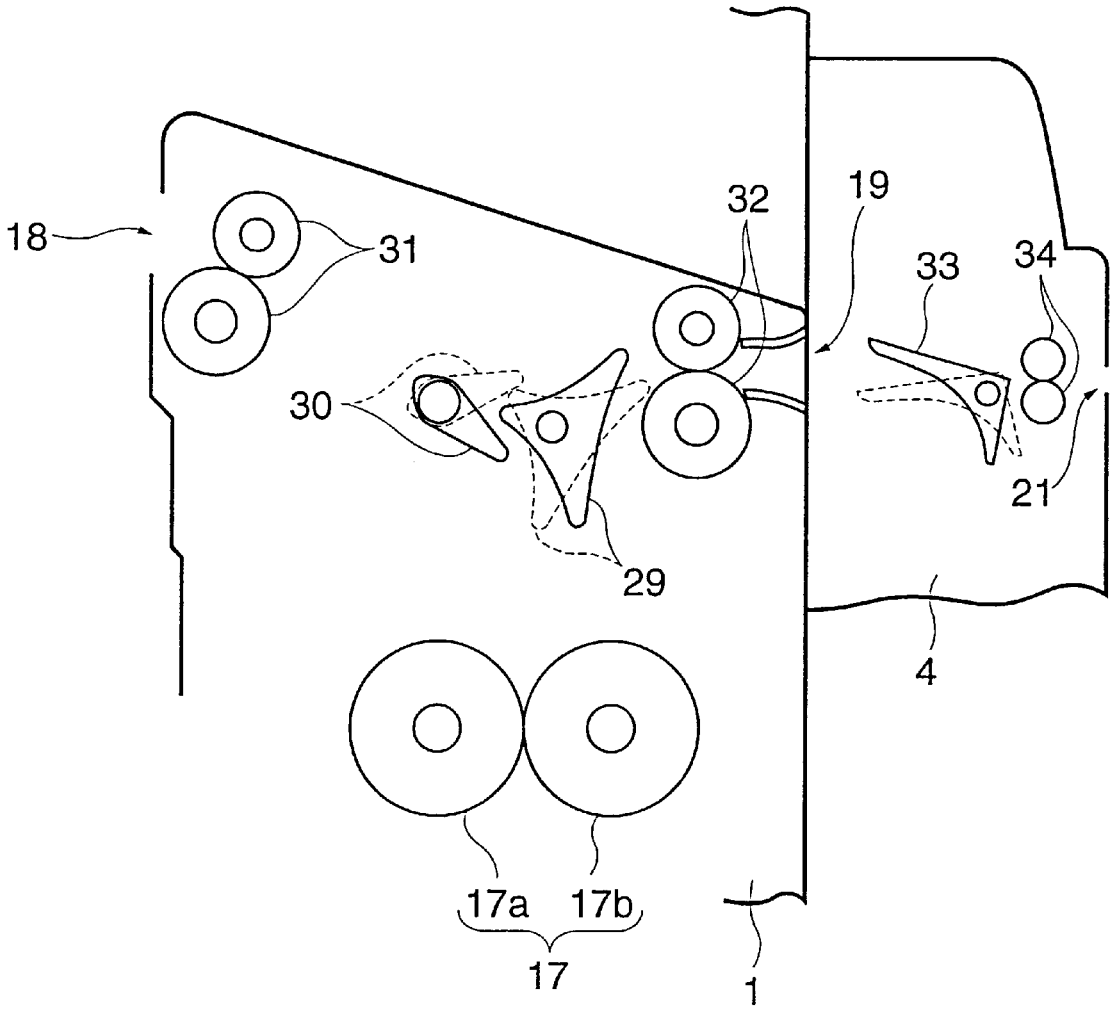
FIG. 6 is a partially enlarged view of FIG. 1 particularly showing a structure around guiding pawls.

Referring now to FIGS. 1 and 6, image forming operation performed by the image forming section 1*b* and paper transport operation performed by the reversible paper transport unit 4 are briefly described. FIG. 6 is a partially enlarged view of FIG. 1 particularly showing a structure around guiding pawls 29, 30. A description of image scanning operation which is performed by the image reading section 1*a* is not provided in this specification.

The operation performed when an image is copied only on one side of a sheet of paper P is described at first.

When the start button 72 shown in FIG. 5 is pressed, an uppermost sheet of paper P is pulled out of the paper cassette 11*a* (or 11*b*) by a rotating feed roller 23*a* (or 23*b* ) having a cut portion on its curved outer surface. The leading edge of the paper P drawn out of the paper cassette 11*a* (or 11*b*) hits against a pair of registration rollers 24*a,* 24*b*. The registration rollers 24*a,* 24*b* temporarily hold the paper P in this position and send it upstream toward the image forming assembly 16 with specific timing.

In the image forming assembly 16, a toner image is transferred onto the side of the paper P facing the photosensitive drum 13 through the previously described process as the paper P passes between the photosensitive drum 13 and the image transfer roller 15. The paper P which has passed through the image forming assembly 16 is transferred to the fixing roller pair 17 and the toner image is fixed, or fused, onto the aforementioned side of the paper P as it passes between the heating roller 17*a* and the pressure roller 17*b*. The paper P which has passed through the fixing roller pair 17 is then transferred toward the paper delivery port 18 if the paper P is to be ejected face down onto the paper delivery table 20 with the printed side of the paper P facing downward, toward the paper output port 19 if the paper P is to be ejected face up with the printed side of the paper P facing upward.

Whether the paper P is transferred toward the paper delivery port 18 or the paper output port 19 is determined by the positions of the guiding pawls 29, 30. More specifically, when the guiding pawls 29, 30 are set in the positions shown by solid lines in FIG. 6, the paper P is guided toward the paper delivery port 18, and when the guiding pawls 29, 30 are set in the positions shown by broken lines in FIG. 6, the paper P is guided toward the paper output port 19.

The paper P guided toward the paper delivery port 18 is ejected by a pair of output rollers 31 through the paper delivery port 18 onto the paper delivery table 20 face down. On the other hand, the paper P guided toward the paper output port 19 is pushed out through the paper output port 19 by a pair of output rollers 32 and transferred into the reversible paper transport unit 4.

The paper P transferred into the reversible paper transport unit 4 is guided by a guiding pawl 33 which is set in a position shown by broken lines in FIG. 6 and is ejected by a pair of output rollers 34 through the paper outlet 21. The paper P ejected through the paper outlet 21 is stacked face up on a finisher, not shown, which is provided as a separate unit. When the reversible paper transport unit 4 is not fitted to the main body 1 of the copying machine A1, the paper P ejected face up through the paper output port 19 is stacked face up on the finisher.

If it is desired to manually feed a sheet of paper P from the manual feed tray 22, and not from any of the paper cassettes 11*a,* 11*b,* the paper P is loaded on the manual feed tray 22 which is fitted to the reversible paper transport unit 4 in such a way that the leading edge of the paper P is inserted into the manual feeding port 12 formed in the main body 1 of the copying machine A1. In this case, the detecting switch 35 senses that the paper P has been loaded on the manual feed tray 22 as the detecting switch 35 is pushed by the leading edge of the paper P. When the start button 72 is pressed subsequently, the controller 60 provided in the main body 1 of the copying machine A1 causes a feed roller 36 to begin rotating upon receiving a paper sensing signal from the detecting switch 35 and a start signal from the start button 72. As a result of the foregoing operation, an uppermost sheet of paper P is pulled out of the manual feed tray 22 and is transferred toward the registration rollers 24*a,* 24*b*.

The operation performed when the feed roller 36 has rotated is the same as the aforementioned operation performed when the paper P is supplied from the paper cassette 11*a* or 11*b*. An operational sequence performed after the detecting switch 35 has sensed the paper P up to a point where the feed roller 36 begins to rotate will be described later with reference to FIG. 8.

If it is desired to manually feed sheets of paper P when the reversible paper transport unit 4 is not fitted to the main body 1 of the copying machine A1, the manual feed tray 51 fitted directly to the main body 1 as illustrated in FIG. 2 can be used.

The operation performed for copying original images on both sides of a sheet of paper P is now described.

It is a first precondition for performing a double-sided copying operation that the reversible paper transport unit 4 is fitted to the main body 1 of the copying machine A1. Whether or not the reversible paper transport unit 4 is fitted to the main body 1 is sensed by the detecting switch 71 provided in the joint area between the main body 1 and the reversible paper transport unit 4.

Although it is possible to manually feed sheets of paper P even when the reversible paper transport unit 4 is fitted to the main body 1 of the copying machine A1 of this embodiment, it is undesirable to manually feed the paper P in a double-sided copying operation. A major reason for this is as follows. When a sheet of paper P carrying a copied image on its one side is ejected from the paper output port 19 of the main body 1 of the copying machine A1, it is transferred to the manual feeding port 12 by the reversible paper transport unit 4 during the double-sided copying operation. If, however, another sheet of paper P is already set in the manual feeding port 12, the sheet carrying the copied image on one side fed from the paper output port 19 would pass over the sheet manually set in the manual feeding port 12. Should this occur, the sheet already set in the manual feeding port 12 will be displaced from its correct feed position due to a frictional force caused by the sheet transferred by the reversible paper transport unit 4 down from the paper output port 19. Another reason is that if the sheet of paper P manually set in the manual feeding port 12 is smaller than the sheet carrying the copied image on one side fed from the paper output port 19, a difference in paper thickness is formed between an area where the two sheets overlap and an area where they do not overlap, and this is likely to cause unstable paper transport operation.

Although no problem will arise if the sheet of paper P manually set in the manual feeding port 12 is completely fed into the main body 1 of the copying machine A1 before the sheet carrying the copied image on one side fed from the paper output port 19 reaches the manual feeding port 12, it is difficult to check in advance whether this will be the case.

Accordingly, a second precondition for performing a double-sided copying operation is that there exists no paper P already set in the manual feeding port 12. In the copying machine A1 of this embodiment, a judgment as to whether this second precondition is met is made by sensing whether or not a sheet of paper P is ready to be manually set imposition. More particularly, if a tray position sensing signal output from the detecting switch 37, which is provided for sensing whether the manual feed tray 22 is retracted in the side wall of the reversible paper transport unit 4, is ON, the controller 60 judges that it is impossible to set any paper P by manual operation and thus the second precondition is satisfied. This makes it possible to prevent the double-sided copying operation from being accidentally initiated when there is already a sheet of paper P manually set in the manual feeding port 12.

Now, the sequence of the double-sided copying operation is described in detail.

While an operator is required to make necessary settings by operating the setup buttons 73 before initiating a double-sided copying operation, the controller 60 controls the copying machine A1 to inhibit such settings unless a signal from the detecting switch 71 which senses that the reversible paper transport unit 4 is fitted to the main body 1 and the aforementioned tray position sensing signal from the detecting switch 37 have already been received. This means that the operator is allowed to make the settings for the double-sided copying operation only if both of the aforementioned first and second preconditions are fulfilled.

Figure 7:
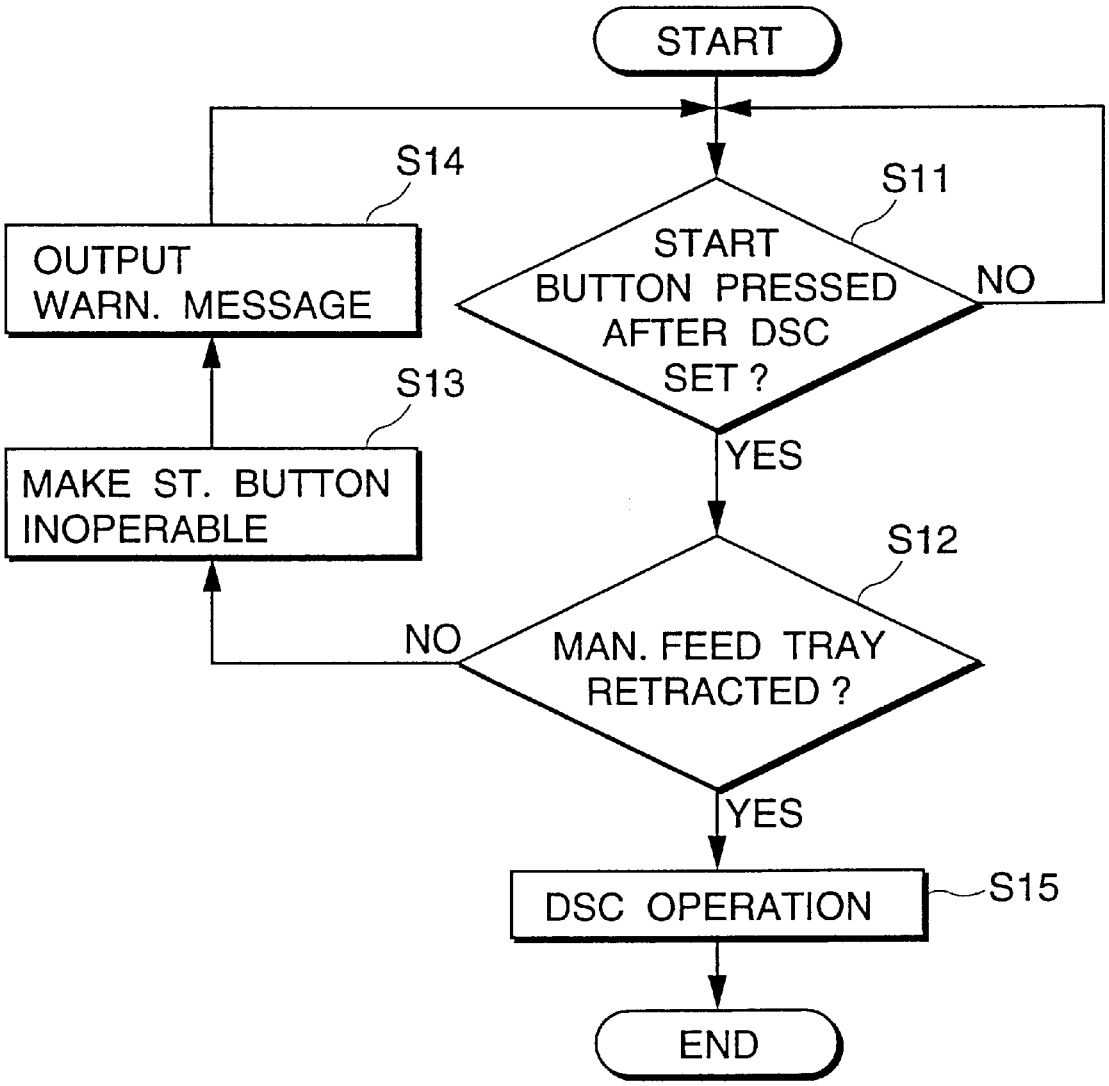
FIG. 7 is a flowchart showing an operational sequence carried out before a double-sided copying operation is commenced.

FIG. 7 is a flowchart showing an operational sequence carried out before the double-sided copying operation is commenced.

Referring to this flowchart, when the operator presses the start button 72 (Yes in step S11) after completing the settings for the double-sided copying operation using the setup buttons 73 of the copying machine A1 which is readily fitted with the reversible paper transport unit 4, it is judged whether the manual feed tray 22 is in its retracted position depending on whether the tray position sensing signal from the detecting switch 37 is present or not (step S12). If the manual feed tray 22 is in the retracted position (Yes in step S12), the double-sided copying operation which will be described later is commenced (step S15). On the other hand, if the manual feed tray 22 is in its unfolded position (Yes in step S12), the start button 72 is made inoperative (step S13) and a warning message reading "Close the manual feed tray", for instance, is shown on the display 74 (step S14). In this case, the operation flow returns to step S11.

When the double-sided copying operation of step S15 begins, a sheet of paper P is pulled out of the paper cassette 11*a* or 11*b* and transferred upward through the image forming assembly 16 and the fixing roller pair 17. An image is copied on one side of the sheet in this process in a manner similar to the aforementioned single-sided copying operation. The paper P which has passed through the fixing roller pair 17 is guided toward the paper delivery port 18 by the guiding pawls 29, 30 set in the positions shown by the solid lines in FIG. 6 and advanced to the outside of the paper delivery port 18 by the output rollers 31.

The output rollers 31 are caused to stop rotating while gripping a portion of the paper P close to its trailing edge. This means that the paper P is pushed out face down onto the paper delivery table 20 with the trailing edge portion of the paper P still left inside the paper delivery port 18.

Subsequently, the guiding pawls 29, 30 are set in the positions shown by the broken lines in FIG. 6 and the output rollers 31 are caused to rotate in a reverse direction to pull the paper P inward through the paper delivery port 18. The paper P is now guided toward the paper output port 19 and pushed out by the output rollers 32. As a result of the above-described switchback operation, the paper feeding direction is reversed and the paper P is turned upside down.

The paper P ejected through the paper output port 19 is transferred into the reversible paper transport unit 4. The paper P thus transferred into the reversible paper transport unit 4 is guided by the guiding pawl 33 which is set in the position shown by the broken lines in FIG. 6 and carried downward through the transfer rollers 38, the paper return guideway 43 and the transfer rollers 39 until the leading edge of the paper P is inserted into the manual feeding port 12. The leading edge of the paper P is detected by the detecting switch 35 when inserted into the manual feeding port 12. Upon receiving the paper sensing signal from the detecting switch 35, the controller 60 causes the feed roller 36 to start rotating with specific timing. An operational sequence carried out from the detection of the paper P by the detecting switch 35 up to the start of rotation of the feed roller 36 will be described later with reference to FIG. 8.

When the feed roller 36 begins to rotate, the paper P is transferred toward the registration rollers 24*a*, 24*b*. As the paper P is further transferred through the image forming assembly 16 and the fixing roller pair 17 subsequently, another image is copied on the reverse side of the paper P. The paper P which has passed through the fixing roller pair 17 is guided by the guiding pawls 29, 30 toward the paper delivery port 18 or the paper output port 19 and eventually discharged.

While the foregoing discussion has illustrated the sequence of the double-sided copying operation, the sequence can be used in its slightly modified form to perform a combined image transfer operation in which more than one image is copied on one side of a single sheet of paper P. This is achieved by re-feeding the paper P through the reversible paper transport unit 4 without turning the paper P upside down in the above-described switchback operation. More particularly, the combined image transfer operation is executed by guiding the paper P which has passed through the fixing roller pair 17 toward the paper output port 19 with the guiding pawls 29, 30 set in the positions shown by the broken lines in FIG. 6.

Figure 8:
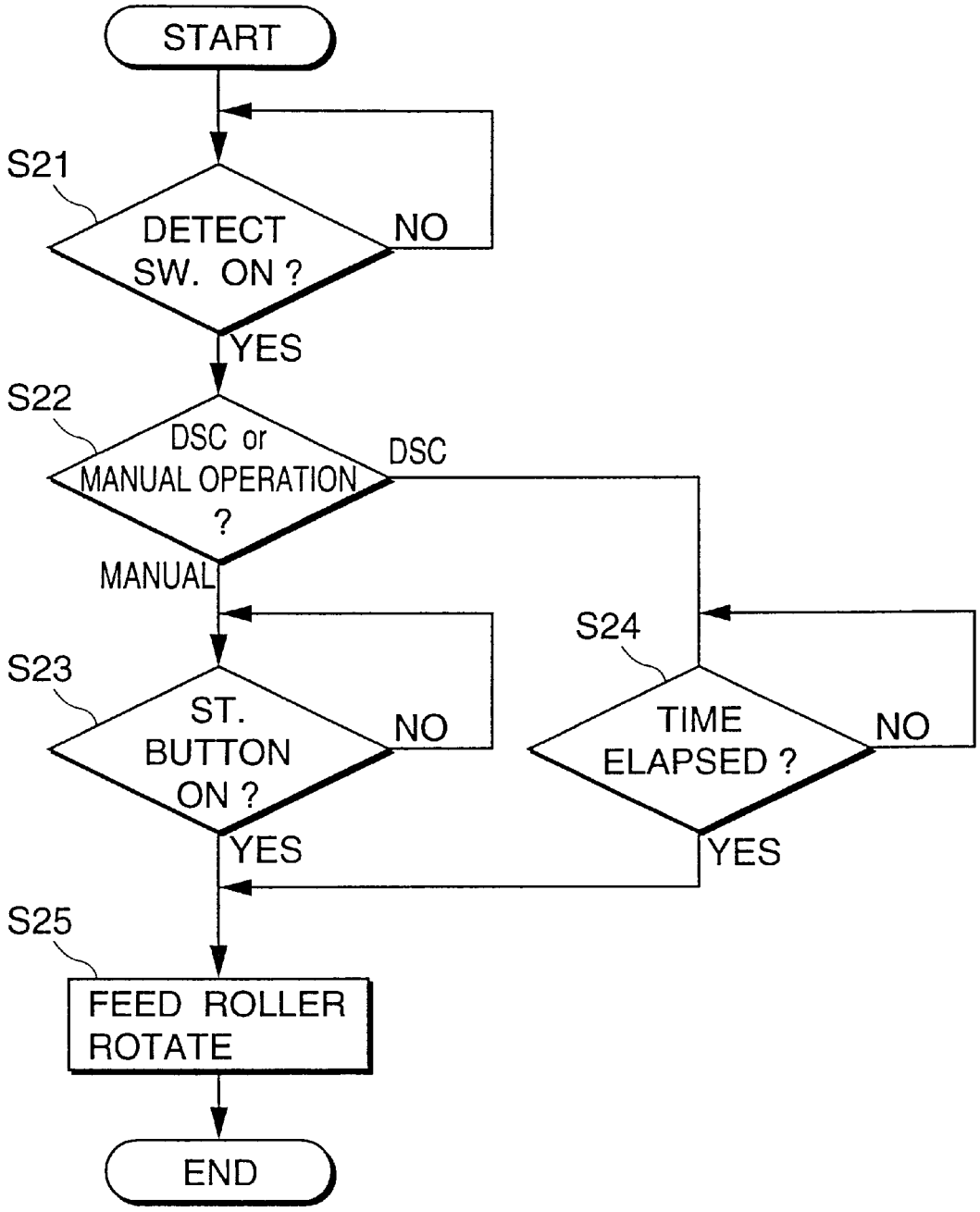
FIG. 8 is a flowchart showing an operational sequence carried out since a detecting switch has detected paper until a feed roller begins to rotate.

FIG. 8 is a flowchart showing the operational sequence carried out since the detecting switch 35 has detected the paper P until the feed roller 36 begins to rotate.

Referring to this flowchart, when the paper P at the manual feeding port 12 is detected by the detecting switch 35 (Yes in step S21), it is judged whether the double-sided copying operation or the manual feeding operation is selected (step S22). If the manual feeding operation is selected (Manual in step S22), the feed roller 36 is caused to rotate (step S25) when the start button 72 becomes ON (Yes in step S23).

On the other hand, if the double-sided copying operation is selected (DSC in step S22), the feed roller 36 is held in a standby condition until a specified period of time elapses after the detecting switch 35 has detected the paper P (step S24). When this period of time has elapsed (Yes in step S24), the feed roller 36 is caused to rotate (step S25).

This form of control is needed because the copying machine A1 has the manual feeding path in a portion of the paper return guideway 43 which is provided for the double-sided copying operation. Since the feed roller 36 is also used in the manual paper feed operation, it is not caused to rotate all the time, but it rotates only when it becomes necessary to advance the paper P by a specified length. It is therefore necessary to properly control the start of rotation of the feed roller 36 in accordance with the position of the paper P in the double-sided copying operation.

As thus far described, the copying machine A1 of this embodiment is constructed such that the reversible paper transport unit 4 detachably fitted to the main body 1 of the copying machine A1 feeds the paper P ejected from the paper output port 19 to the manual feeding port 12. In the double-sided copying operation, the paper P is transferred again to the image forming assembly 16 through the same portion of the paper return guideway 43 as used in the manual paper feed operation. In this construction, it is not necessary to provide an extra paper path for feeding the paper P from outside the main body 1 up to the image forming assembly 16 other than the manual feeding path used in the aforementioned manual paper feed operation in the main body 1 of the copying machine A1. Thus, the construction of the copying machine A1 makes it possible to combine separate paper paths from outside the main body 1 to its internal image forming assembly 16 (as conventional copy machines) into a single path, and eventually achieve improved space utilization efficiency and cost reduction.

While the invention has been described with reference to its preferred embodiment, the invention is not limited to the foregoing embodiment but may be applied in many varied forms thereof.

The copying machine A1 of the foregoing embodiment is constructed such that the reversible paper transport unit 4 is fitted to its main body 1 after removing the manual feed tray 51 from the main body 1 as shown in FIG. 3. This is because the manual feeding port 12 is closed by the manual feed tray 51 if the reversible paper transport unit 4 is fitted to the main body 1 of the copying machine A1 with the manual feed tray 51 retracted in the side wall of the main body 1 as the manual feed tray 22 is retracted in the side wall of the reversible paper transport unit 4.

According to a first variation of the embodiment, a manual feed tray 52 to be attached to the main body 1 of the copying machine A1 has a slot 55 at a position corresponding to the manual feeding port 12. With this manual feed tray 52, the manual feeding port 12 will not be closed even when the manual feed tray 52 is retracted in the main body 1 of the copying machine A1. As a consequence, it will no longer be necessary to remove the manual feed tray 52 when fitting the reversible paper transport unit 4 to the main body 1 of the copying machine A1.

Figure 9:
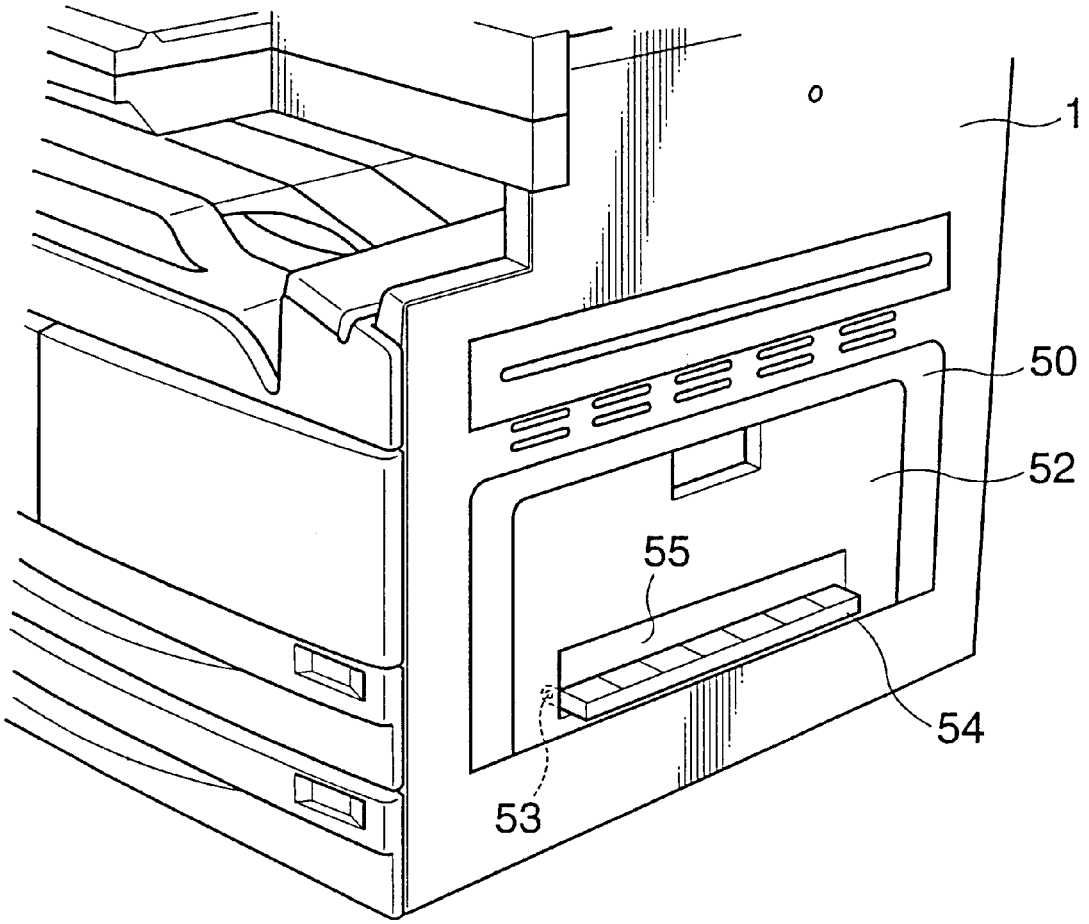
FIG. 9 is a perspective diagram showing a state in which the manual feed tray having a slot is retracted in the main body of the copying machine.
Figure 10:
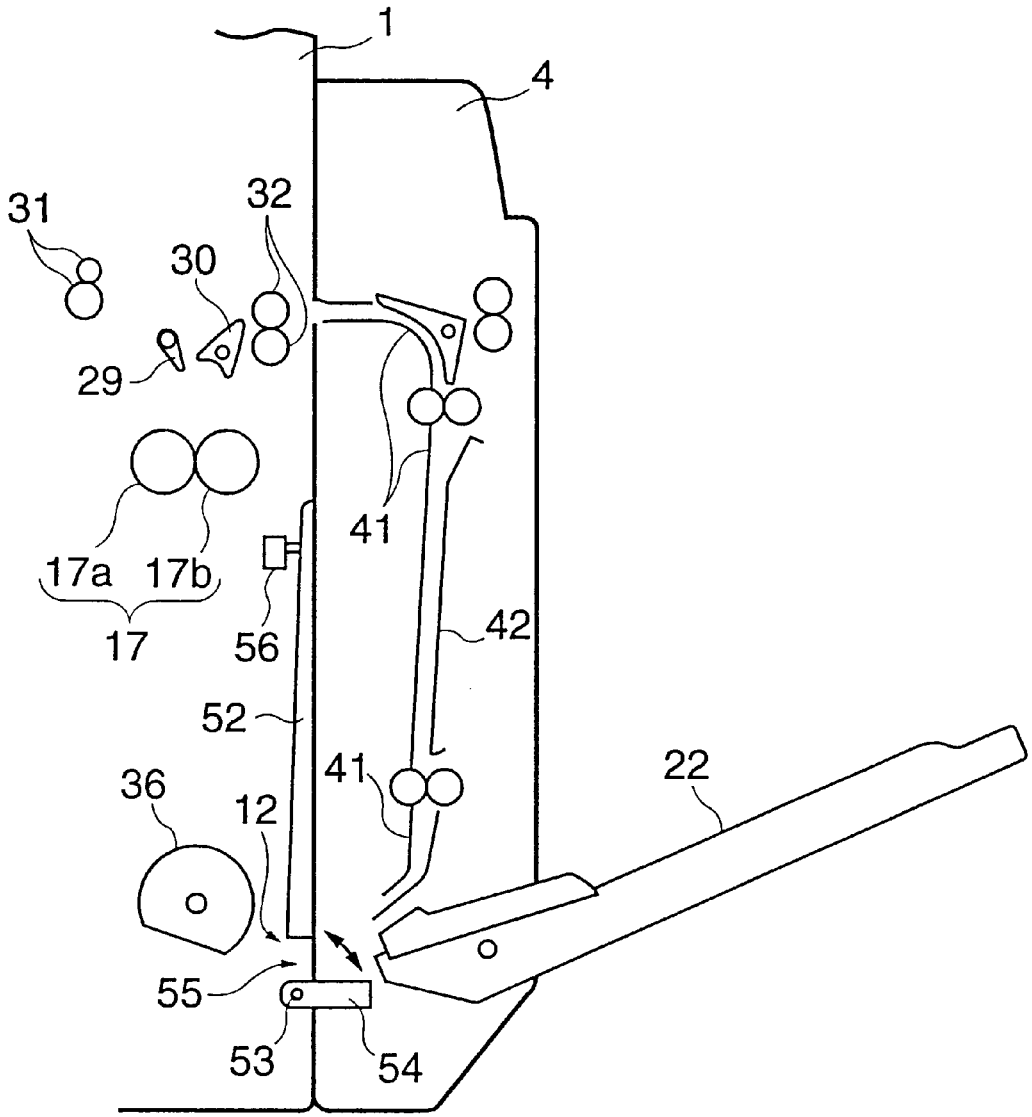
FIG. 10 is a fragmentary elevational view showing a state in which the reversible paper transport unit is fitted to the main body of the copying machine shown in FIG. 9.

FIG. 9 is a perspective diagram showing a state in which the manual feed tray 52 having the slot 55 is retracted in the main body 1 of the copying machine A1, and FIG. 10 is a fragmentary elevational view showing a state in which the reversible paper transport unit 4 is fitted to the main body 1 of the copying machine A1 shown in FIG. 9.

The main body 1 of the copying machine A1 of this variation is provided with the manual feed tray 52 and a detecting switch 56 as shown in FIG. 10. This manual feed tray 52 has a swing-out flap 54 which can be swung outward about a pivot 53 from a position retracted in the main body 1 of the copying machine A1 as well as the slot 55 which opens when the swing-out flap 54 is swung outward, as shown in FIG. 9. This slot 55 is formed at the position corresponding to the manual feeding port 12 in the main body 1 of the copying machine A1 as shown in FIG. 10 and, therefore, the slot 55 is not closed even when the manual feed tray 52 is retracted in the main body 1.

The detecting switch 56 is disposed at a position where the manual feed tray 52 is retracted. When the manual feed tray 52 is retracted in the main body 1 of the copying machine A1, the detecting switch 56 is turned ON to sense that the manual feed tray 52 has been retracted. In this variation of the preferred embodiment, the controller 60 serves the function of a tray position sensing block which judges whether the manual feed tray 52 is retracted into the main body 1 of the copying machine A1 according to on/off states of the detecting switch 56 which is shown by broken lines in FIG. 5. The controller 60 performs the function of the paper re-feed control block 64 which controls the individual elements of the reversible paper transport unit 4 only when it is fitted to the main body 1 of the copying machine A1 and the manual feed tray 22 is retracted into the reversible paper transport unit 4.

While the copying machine A1 of the foregoing preferred embodiment is provided with the detecting switch 37 for sensing whether the manual feed tray 22 is retracted in the side wall of the reversible paper transport unit 4 and the controller 60 judges that it is impossible to set any paper P by manual operation and thus the second precondition is satisfied when the tray position sensing signal output from the detecting switch 37 is ON (or when the manual feed tray 22 is in its retracted position), means for judging whether the second precondition is satisfied is not limited to this method. As an alternative, a judgment as to whether the second precondition is satisfied can be made by sensing the presence of paper P on the manual feed tray 22, if any, with reference to the paper sensing signal output from the detecting switch 35, for example. In this variation of the preferred embodiment, the detecting switch 35 constitutes a paper sensor (or paper detector).

While the reversible paper transport unit 4 is made detachable from the copying machine A1 in the foregoing preferred embodiment, it need not necessarily be detachable but may be permanently fixed to the copying machine A1.

While the invention has been particularly shown and described with respect to the preferred embodiments thereof, it will be understood by those skilled in the art that the foregoing and other changes in form and details may be made therein without departing from the spirit and scope of the invention, which should be limited only by the scope of the appended claims.

What is claimed is:

1. An image forming apparatus for forming images on a single side of paper or on both sides of paper, comprising:

a main body having a paper feeding port through which paper passes into said main body and a paper output port through which paper passes out of said main body;

an image forming unit arranged in said main body for forming an image on paper;

a paper transport mechanism for transporting paper from said paper feeding port to said image forming unit;

a paper ejector for ejecting the paper carrying the image formed by said image forming unit out of said main body through said paper output port;

a device mounting portion arranged in said main body;

a paper return device detachably connectable to said device mounting portion and having a paper return guideway connecting said paper output port to said paper feeding port when said paper return device is connected to said main body, said paper return device being arranged to feed a paper ejected out of said main body from said paper output port to said paper feeding port through said paper return guideway to thereby enable the formation of images on both sides of the paper;

a paper tray detachably connectable to said device mounting portion and arranged relative to said paper feeding port to enable paper to be fed from said paper tray through said paper feeding port into said main body when said paper tray is connected to said main body, whereby said paper tray or said paper return device is selectively arranged in connection with said device mounting portion; and said paper return device including a paper tray arranged in alignment with said paper feeding port when said paper return device is connected to said device mounting portion and which enables paper to be feed therefrom through said paper feeding port into said main body, said paper tray of said paper return device being openable and closeable.

2. The image forming apparatus according to claim 1, further comprising a tray position detector for detecting whether said paper tray of said paper return device is opened or closed.

3. The image forming apparatus according to claim 2, wherein said tray position detector includes a paper detector which detects the presence of paper loaded on said paper tray of said paper return device.

4. The image forming apparatus according to claim 1, further comprising a paper re-feed controller for controlling said paper return device such that said paper return device is operable only when said paper tray of said paper return device is closed.

5. In an image forming apparatus including a main body having a paper feeding port through which paper passes into the main body and a paper output port through which paper passes out of the main body, an image forming unit arranged in the main body for forming an image on paper, a paper transport mechanism for transporting paper from the paper feeding port to the image forming unit, a paper ejector for ejecting the paper carrying the image formed by the image forming unit from the main body through the paper output port, the improvement comprising:

a unit mounting part arranged in the main body;

a paper return device detachably connectable to a device mounting part such that said paper return device is exterior of the main body, said paper return device including a paper return guideway having a first opening adapted to be in alignment with the paper output port and a second opening adapted to be in alignment with the paper feeding port when said paper return device is connected to the main body such that paper ejected from the paper output port is feedable through said paper return guideway to the paper feeding port;

a paper tray detachably connectable to said unit mounting part and adapted to be arranged relative to the paper feeding port to enable paper to be fed from said paper tray through the paper feeding port into the main body when said paper tray is connected to the main body, whereby said paper tray or said paper return device is selectively arranged in connection with said unit mounting part; and said paper return device including a retractable paper tray arranged in alignment with the paper feeding port when said paper return device is connected to said unit mounting part and which enables paper to be feed therefrom through the paper feeding port into the main body.

6. The image forming apparatus according to claim 5, further comprising a tray position detector for detecting whether said paper tray of said paper return device is retracted.

7. The image forming apparatus according to claim 6, wherein said tray position detector includes a paper detector which detects the presence of paper loaded on said paper tray of said paper return device.

8. The image forming apparatus according to claim 5, further comprising a paper re-feed controller for controlling said paper return device such that said paper return device is operable only when said paper tray of said paper return device is closed.

* * * * *